United States Patent [19]

Sawyer et al.

[11] 4,196,252

[45] Apr. 1, 1980

[54] COATED FABRIC BELT

[75] Inventors: John M. Sawyer, Cuyahoga Falls; John R. Harris, Uniontown, both of Ohio

[73] Assignee: The Goodyear Tire & Rubber Company, Akron, Ohio

[21] Appl. No.: 22,573

[22] Filed: Mar. 21, 1979

[51] Int. Cl.[2] ..... B32B 5/16; B32B 27/04

[52] U.S. Cl. ..... 428/246; 428/248; 428/252; 428/260; 428/262; 428/264; 428/265; 428/269; 428/283; 428/326

[58] Field of Search ..... 428/240, 245, 246, 248, 428/251, 252, 264, 265, 267, 268, 425, 260, 262, 326, 283; 260/37 N

[56] References Cited

U.S. PATENT DOCUMENTS 4,002,791 1/1977 Sawyer ..... 428/326

*Primary Examiner*—James J. Bell

*Attorney, Agent, or Firm*—J. D. Wolfe

[57] ABSTRACT

A woven fabric belt having a coating of polyurethane on each face and extending through the interstices of the fabric. The polyurethane is the reaction product of a polytetramethylene ether glycol of 4,4'-methylene di(cyclohexylene isocyanate) cured with m-phenylene diamine and having at least one face of said belt covered with the polyurethane having walnut shell powder incorporated therein.

3 Claims, No Drawings

COATED FABRIC BELT

TECHNICAL FIELD

This invention relates to a belt composed of a woven fabric having a uniform coating thereon of a prepolymer of polytetramethylene ether glycol and alicyclic isocyanate cured with m-phenylene diamine to form a woven fabric belt after press curing having a uniform thickness.

BACKGROUND ART

U.S. Pat. No. 4,002,791 also describes a method of making a polyurethane belt. Heretofore fabrics have been coated utilizing cements or solvent solutions of the coating material on cement spreaders or in calendering equipment. Also, fabric has been coated by spraying on various solvent solutions of cements and allowing the solvent to evaporate. One of the disadvantages of coating fabric according to these methods is the trouble experienced with getting sufficient penetration of the cement into the interstices of the woven fabric. Another difficulty is getting a uniform coat on the fabric and especially is this difficult where the resulting coated fabric, viz. the belt, is to be utilized on a roll where the amount of fabric to be placed on a roll is limited and a few mils difference in thickness could affect the amount placed on the roll or the ability to wind and unwind the belt on the roll at high speeds.

DISCLOSURE OF THE INVENTION

An object of this invention is to provide a belt having a uniform thickness and hydrolysis resistant polyurethane covering.

The objects of this invention may be accomplished by applying at least one coat of a specific fluid polyurethane reaction mixture to a woven fabric to coat fabric, allowing the reaction mixture to cure to a tack-free condition before the application of additional coats and then placing the coated fabric in essentially a tack-free condition in a press and pressing at sufficient temperature and pressure to force the coating material while in a relatively cured state into the interstices of the fabric to thereby obtain a coated fabric having a predetermined thickness and freedom from occluded gas bubbles.

The coatings may be applied to the fabric by either spraying the reactive mixture onto the fabric or it may be applied on a spreader and smoothed to a desired thickness by means of a doctor blade or roll. Once the coating has been applied to the fabric and cured sufficiently to give a coating which is essentially tack free an additional coat may be applied in accordance with the previously indicated procedures. The coating on at least one face of the fabric must be with a reaction mixture containing ground walnut shells. Then the fabric is placed in a flat curing press or rotary curing machine under sufficient temperature and pressure to render the tack free coating fluid or flowable and thereby force the coating into the interstices of the fabric to yield a belt of uniform gauge.

BEST MODE FOR CARRYING OUT THE INVENTION

To more specifically illustrate this invention a woven polyamide or polyester fabric such as that used in normal belts is coated with a polyurethane reaction mixture to give a tack-free coating of preferably 0.05±0.25 centimeter on each face of the fabric, but thicker if desired. Preferably at least one face of the fabric is coated with a polyurethane reaction mixture containing sufficient ground walnut or nut shell powder of 40 to 60 mesh U.S. Standard Sieve to give the face a coefficient of friction greater than that yielded by polyurethane alone. The coating can be applied either by spraying or doctoring onto fabric as the fabric moves past the coating station.

After the polyurethane coating of at least 0.381 centimeter has been applied and is tack free the coated fabric is placed in a press at about 110° to 120° C. for 10 minutes at 7 kilograms per square centimeter pressure to force the polyurethane to penetrate the interstices of the woven fabric to give a belt of uniform gauge and a smooth surface.

To specifically illustrate an embodiment of this invention a nylon woven belt fabric was placed on a flat surface and given a spray coat of a polyurethane reaction mixture and allowed to be exposed to the air until the polyurethane reaction mixture had substantially cured to give a tack free surface. Then an additional coat of polyurethane was applied to build the coating on the fabric to a thickness of about 0.16 centimeter to 0.63 centimeter. Then the fabric containing the polyurethane coating was turned over to expose the other side of the fabric and it was likewise given two coats of the polyurethane reaction mixture. When the coatings on the fabric had cured for 10 to 100 hours the fabric was placed in a flat press and pressed at 21.09 kilograms per square centimeter for 6 to 15 minutes at 130° C. Then the fabric was removed from the press and tested. The test indicated that the cloth covered belt was substantially the same thickness with no variation from one end to the other. Also, on examination it was observed that the polyurethane after the press treatment had penetrated throughout the fabric interstices and there were no air bubbles. Furthermore the pressure treatment improved the physical properties of the belt. This belt was placed on test and found suitable for use as the belting in an aircraft arresting gear unit.

The polyurethane reaction mixture utilized was 100 parts of a prepolymer of a mixture of one mol of a polytetramethylene ether glycol of 1000 molecular weight with two mols of 4,4'-methylene (di(cyclohexylene isocyanate) which had been reacted to give a free NCO content of 5.2 to 5.6 percent by weight and 22.71 parts of a curative made by mixing 240 parts of m-phenylene diamine, 37.3 parts of a resinous surface tension or leveling agent available as "Modaflow" from Monsanto Chemical Company and 559 parts of Cellosolve acetate.

The coating of at least one face of the fabric is coated with the above polyurethane reaction mixture which contains 12.27 parts of walnut shell powder per 100 parts of prepolymer to give that face of the belt a greater coefficient of friction and thus control the backlash of the belt as it is wound and unwound on rolls at very high speed and loads. Belts made as above and cured at room temperature for several days had excellent hydrolysis resistance. The speed of the reaction may be varied by utilization of various catalysts such as tertiary amines or the metal catalysts such as tin octoate.

INDUSTRIAL APPLICABILITY

Any of the well known fabrics useful in making belts may be utilized and especially desirable are those fabrics made from glass, cellulose, the polyamides such as nylon, and the modified cellulose.

While certain representative embodiments and details have been shown for the purpose of illustrating the invention it will be apparent to those skilled in this art that various changes and modifications may be made therein without departing from the spirit or scope of the invention.

We claim:

1. A woven fabric belt having a coating of polyurethane on each face and extending through interstices of the fabric, the polyurethane comprising the reaction product of a polytetramethylene ether glycol, 4,4'-methylene di(cyclohexylene isocyanate) cured with m-phenylene diamine and at least one face of said belt contains said polyurethane having walnut shell powder incorporated therein.

2. The woven fabric belt of claim 1 wherein the shell powder is 5 to 15 percent by weight of the polyurethane.

3. The woven fabric belt of claim 1 wherein the polyurethane comprises the reaction product of a mol of a polytetramethylene ether glycol with 1.5 to 2.5 mols of 4,4'-methylene di(cyclohexylene isocyanate) with sufficient m-phenylene diamine to be equivalent to 87 to 98 percent free NCO content relative to the glycol.

* * * * *